US005755131A

United States Patent [19]

Voth

[11] Patent Number: 5,755,131

[45] Date of Patent: May 26, 1998

[54] METHOD OF AND APPARATUS FOR REMOVING CAMBER FROM MULT STRIPS

[75] Inventor: Karl E. Voth, Hesston, Kans.

[73] Assignee: The Bradbury Company, Inc., Moundridge, Kans.

[21] Appl. No.: 394,255

[22] Filed: Feb. 21, 1995

[51] Int. Cl.[6] ..... B21B 31/07; B21B 1/00

[52] U.S. Cl. ..... 72/240; 72/203

[58] Field of Search ..... 72/129, 160, 161, 72/181, 203, 204, 365.2, 366.2, 240, 248, 11.7, 247, 252.5; 83/425, 425.2

[56] References Cited

U.S. PATENT DOCUMENTS

| | | | |
|---|---|---|---|
| 1,125,984 | 1/1915 | Dumas . | |
| 2,561,634 | 7/1951 | Picton | 153/54 |
| 2,601,794 | 7/1952 | Wood | 80/55 |
| 2,774,263 | 12/1956 | Leufven | 80/56 |
| 3,006,225 | 10/1961 | Mamas | 72/248 |
| 3,348,403 | 10/1967 | Bartley | 72/237 |
| 3,452,568 | 7/1969 | Vihl | 72/161 |
| 3,724,251 | 4/1973 | Wegner | 72/203 |
| 3,823,592 | 7/1974 | Colbath | 72/181 |
| 4,033,165 | 7/1977 | Arimura et al. | 72/205 |
| 4,145,905 | 3/1979 | Mattie | 72/181 |
| 4,187,710 | 2/1980 | Stikeleather | 72/204 |
| 4,237,714 | 12/1980 | Polukhin et al. | 72/242 |
| 4,724,695 | 2/1988 | Stoehr | 72/181 |
| 4,787,232 | 11/1988 | Hayes | 72/176 |
| 4,872,330 | 10/1989 | Nonini | 72/203 |
| 4,912,956 | 4/1990 | Matricon et al. | 72/245 |
| 4,959,986 | 10/1990 | Kranis, Sr. | 72/129 |
| 4,969,347 | 11/1990 | Matsuo et al. | 72/247 |
| 4,974,435 | 12/1990 | Vandenbroucke | 72/176 |
| 5,158,002 | 10/1992 | Matsunaga et al. | 83/479 |
| 5,163,311 | 11/1992 | McClain et al. | 72/181 |
| 5,284,042 | 2/1994 | Benedetti | 72/204 |

FOREIGN PATENT DOCUMENTS

| | | |
|---|---|---|
| 1 777 039 | 8/1968 | Germany . |
| 42 4763 | 8/1965 | Japan . |
| 60-133903 | 7/1985 | Japan . |
| 1085708 | 4/1984 | U.S.S.R. . |

OTHER PUBLICATIONS

Graham et al., "Economic Advantages of On-Line Control of Camber and Gauge in ERW Tube/Pipe Production", presented at Tubeworld '95 conference (exact date of conference unknown to applicant).

*Primary Examiner*—Lowell A. Larson
*Assistant Examiner*—Rodney Butler
*Attorney, Agent, or Firm*—Marshall, O'Toole, Gerstein, Murray & Borun

[57] ABSTRACT

The invention is a method of and apparatus for removing camber from MULT strips by passing the MULT strip through a rolling mill having rolls with contacting surfaces vertically adjustable and positioned to reduce the thickness of the MULT strip from its short edge in reduced amounts thereacross to the opposite edge, so as to eliminate or reduce camber in the MULT strip prior to passing the strip through a roll-forming and punching line.

11 Claims, 1 Drawing Sheet

FIG 1
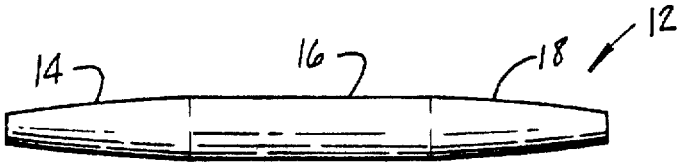
FIG 2
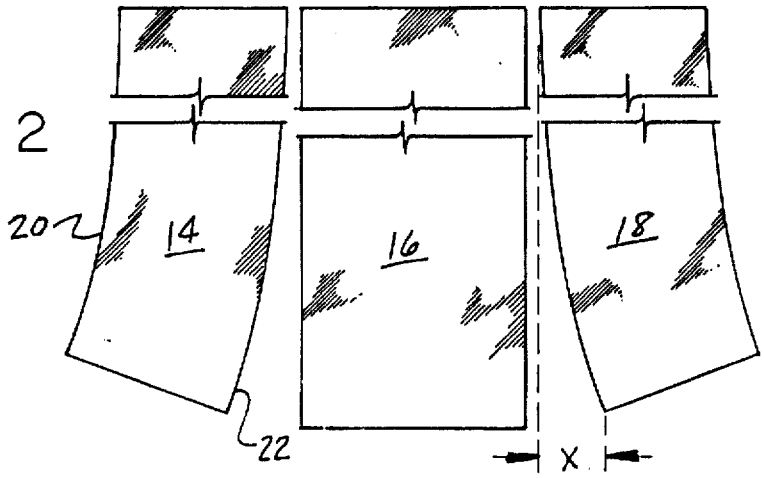
FIG 3
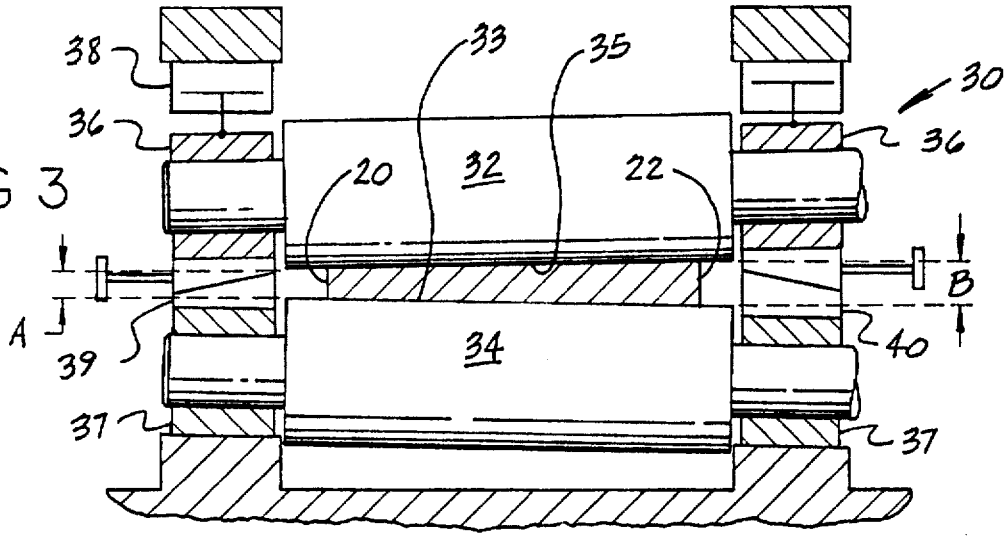
FIG 4
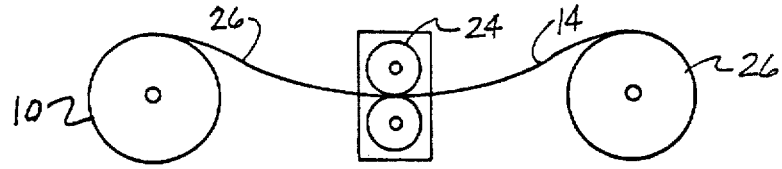
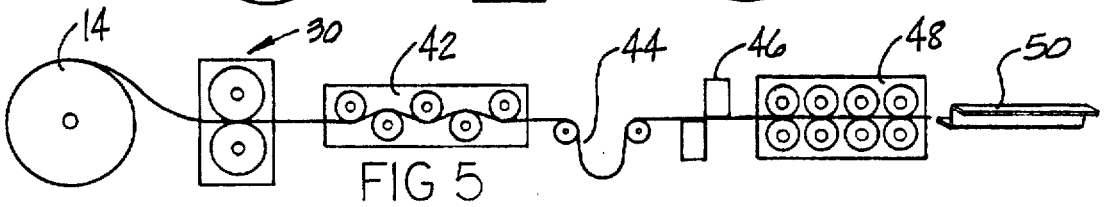
FIG 5

METHOD OF AND APPARATUS FOR REMOVING CAMBER FROM MULT STRIPS

FIELD OF THE INVENTION

This invention relates to roll-forming MULT strips which have a substantial length, and in particular eliminating the excessive camber in MULT strips.

DESCRIPTION OF THE PRIOR ART

It has always been a goal in steel rolling mills to roll thin gauge sheets which have uniform thickness across the sheet; however, it has been very difficult to obtain. The rolling forces transmitted to the rolls due to the squeezing action on the sheet applies a substantial bending load and deflection across the width of the roll with its maximum point of deflection usually at the center of the roll. These roll-separating forces on the rolls can be substantial and are affected by the hardness of the steel being rolled along with the reduction in thickness the mill is rolling. Various techniques have been historically used to eliminate this roll deflection, such as large diameter back-up rolls and applying reverse bending forces in the neck areas of the rolls.

While numerous attempts to achieve uniform thickness across the sheet have been attempted, most rolled thin sheets do not have uniform thickness thereacross and are usually tapered from the outer edges inward with the thickest area in the center. This non-uniform rolling creates compressive and tensile residual stress problems in the rolled sheet. When these stresses exceed certain limits, the sheet results in a phenomenon called "buckling" which is described in detail in U.S. Pat. No. 4,033,165.

Variations in the thickness distribution across the width of a rolled sheet are influenced not just by deflection of the rolling mill rolls but also other factors, such as thermal expansion of the mill rolls caused by the heat input from the sheet being rolled, wear of the mill rolls and other factors.

In the roll forming technology, a master coil is typically cut into a plurality of strips, called MULTS, an acronym for multiple strips, by a slitter device generally typified in U.S. Pat. No. 5,158,002. The MULT strips can vary in width up to 24 inches or more and can include 2 or more strips depending upon the width of the master coil and the width of the individual MULT strips. Since the overall thickness across the sheet of the master coil varies in thickness, the MULT strips will also vary in thickness across their widths. Typically the outer MULT strips will have excessive camber in their length, as seen in plan, which is unacceptable in certain applications. If the MULT strips are intended for roll forming or press braking into elongated sections, such as zee purlins, excessive camber creates problems. More than one-half inch of camber in 20 feet of length is unacceptable with some roll-formed sections and in some application even less than that is unacceptable.

The prior art has attempted to solve this problem by pushing the edges of the sheet to eliminate camber. They have also tried to reverse twist a formed purlin. Camber is a problem also in stamping, punching and bending by press brakes.

SUMMARY OF THE INVENTION

The present invention solves this excessive camber problem by rolling the short edge of the MULT strip to increase its length to approximate that of the long edge and eliminate the camber. Whether the short edge of the MULT strip before rolling is either thinner or thicker makes no difference in the roll-forming process of forming a purlin. The rolls in the rolling mill stand are set with a roll gap tapered from the short edge of the MULT strip toward its long edge progressively less across the full width of the MULT strip.

Therefore, the principal object of the present invention is to provide a method of camber removal from MULT strips of substantial length.

Another object of the present invention is to provide an improved method of forming elongated roll-formed sections from MULT strips.

BRIEF DESCRIPTION OF THE DRAWING

FIG. 1 is a lateral cross-sectional view of the width of a master coil slit into three MULT strips;

FIG. 2 is a plan view of the MULT strips with portions removed and the camber in the strips exaggerated;

FIG. 3 is an elevational view of a rolling mill stand symbolically shown with the roll gap reduced along its left edge;

FIG. 4 is a schematic representation of a slitter and a recoiler of the MULT strips; and FIG. 5 is a schematic representation of the present invention in a typical roll-forming line for structural purlins.

DESCRIPTION OF THE PREFERRED EMBODIMENT

Referring now to the drawings and more specifically to FIGS. 1 and 2, a coil of sheet steel as it comes from the mill can be rolled in various widths and gauges and is referred to as a master coil. A cross-section of the coil sheet 12 is illustrated in FIG. 1 with exaggerated variations in thickness. The master coil 10 is unwound and the sheet 12 is run through a slitter device 24 (FIG. 4), well known in the prior art, which slits the sheet 12 into a plurality of longitudinal strips, generally referred to in the art as MULTS.

In FIGS. 1 and 2, the coil sheet 12 is slit into three MULT strips 14, 16 and 18. The strips can vary in width from 2 inches to 24 inches and each strip can vary in thickness from one edge to the other up to 0.005 inches. The sheet material can vary in gauge from 7 to 16 and master coil width up to 72 inches.

The thickness across the width of the sheet in the master coil will vary. However, typically the edges of the master sheet will be thinner than the center section, as shown in the exaggerated scale in FIG. 1. While steel companies strive to roll a flat sheet, most of them produce a sheet similar to that shown in FIG. 1. Typically the outer MULT strips 14 and 18, once they are severed from the master sheet 12, will take up a curved shape, as illustrated in FIG. 2, with an amount of camber X, as shown in MULT strip 18. Portions of the strip length are not shown and the camber amount is exaggerated for purposes of illustration; however, the maximum acceptable amount of camber in a 20-foot strip could be one-half an inch in some applications but in others it could be 1/16 inch. Quite often the MULT strips in the center of the master coil will not have excessive amounts of camber, as illustrated by center MULT strip 16.

MULT strip 14 has a short concave edge 20 and a long convex edge 22.

FIG. 3 illustrates a conventional rolling mill 30 which includes a pair of pinch rollers 32 and 34, each having contacting surfaces 33 and 35 which define the roll gap between the rolls. The upper pinch roll 32 is adjustably positioned by hydraulic cylinders 38 which urge roll bearings 36 against adjustable wedge members 39 and 40 which in turn are urged against bearings 37 which support lower pinch roll 34 against the frame member of the rolling mill.

The roll gap on each side of mill 30 is set so that the gap A will roll the short edge 20 sufficiently to increase the length of the short edge 20 to more closely correspond with the length of the long edge 22. The roll gap B on the right side of the mill 30 is set with a roll gap approximately the same as the thickness of the right edge 22. The amount of rolling achieved by the mill varies across the strip from a maximum at the left edge 20 to zero or a minimum at the right edge 22. This rolling across the full width of MULT strip 14 extends the length of the strip on its left edge 20 so as to substantially remove the camber from the overall strip 14. The roll gap in rolling mill 30 can be adjusted to suit the particular MULT strip being rolled. For example, if the short side of the MULT strip is on the right, roll gap B will be adjusted so as to roll the short edge of the MULT strip sufficiently to elongate it and reduce or eliminate its camber.

FIG. 4 illustrates a master coil 10 feeding a slitter 24 which in turn feeds a series of MULT strips onto a recoiler 26. The MULT strips can either be recoiled or they can be selectively passed directly into the processing line. FIG. 5 illustrates a recoiled MULT strip 14 which feeds rolling mill 30, a straightening roll leveler line 42, a loop pit 44, a shear 46 and a roll-forming line 48 which produces the completely formed product, such as a zee purlin 50. A press brake, not shown could be used in place of the roll forming line 48. Whether the MULT strips are recoiled and stored before use or left flat in the processing line is a matter of choice.

It will be understood that the above-described embodiments of the invention are for the purpose of illustration only. Additional embodiments and modifications can be anticipated by those skilled in the art based on a reading and study of the present disclosure. Such additional embodiments and modification may be fairly presumed to be within the spirit and scope of the invention as defined by the subtended claims.

I claim:

1. Method of forming elongated members from MULT strips comprising the steps of:

unrolling and slitting a master coil into MULT strips some of which have excessive camber with a concave edge and a convex edge;

passing all of the MULT strips with excessive camber through a rolling mill having rolls with contacting surfaces adjustably positioned to reduce the thickness of the MULT strips from their concave edges in reduced amounts thereacross towards their convex edges; and forming the straightened MULT strips into elongated structural members.

2. Method of forming elongated roll-formed members from MULT strips comprising the steps of:

unrolling and slitting a master coil into MULT strips some of which have excessive camber with a concave edge and a convex edge;

passing all of the MULT strips with excessive camber through a rolling mill having rolls with contacting surfaces adjustably positioned to reduce the thickness of the MULT strips from their concave edges in reduced amounts thereacross towards their convex edges; and roll forming the straightened MULT strips into elongated members.

3. Method of forming and punching elongated members from MULT strips comprising the steps of:

unrolling and slitting a master coil into a plurality of MULT strips some of which have excessive camber with a concave edge and a convex edge;

passing all of the MULT strips with excessive camber through a rolling mill where the width of the roll gap is less along the concave edges of the strips and tapered towards the convex edges;

passing the MULT strips through a series of straightening rolls;

shearing the MULT strips to length; and passing the MULT strips through a forming and punching line to form the elongated members.

4. Apparatus for a sheet metal forming line including:

a master coil;

a slitter means which cuts the master coil into a series of MULT strips some of which have excessive camber with a concave edge and a convex edge;

rolling mill means which selectively rolls the short concave edge of the MULT strips which have excessive camber to straighten;

a roll forming line which receives the straightened MULT strips and forms them into elongated members.

5. Apparatus for a sheet metal forming line including:

a master coil;

a slitter means which cuts the master coil into a series of MULT strips some of which have excessive camber with a concave edge and a convex edge;

rolling mill means which selectively rolls the short concave edge of the MULT strips which have excessive camber to straighten;

straightening rolls which pass the straightened MULT strips;

shearing means which cut the strips to lengths, and a roll forming line which receives the straightened MULT strips and forms them into elongated members.

6. Method of removing camber from a strip of material having an initial amount of camber, the strip having a relatively short concave edge and a relatively long convex edge, with the use of a pair of rollers having a roll gap between them, said method comprising the steps of:

setting the roll gap between the pair of rollers so that when the strip is subsequently passed between the rollers, the relatively short concave edge of the strip is lengthened; and after the roll gap is set, passing the strip between the rollers so that the relatively short concave edge of the strip is lengthened to reduce the initial amount of camber.

7. Method of forming a strip of material having an initial amount of camber, the strip having a relatively short concave edge and a relatively long convex edge, with the use of a pair of rollers having a roll gap between them and a roll-forming line, said method comprising the steps of:

setting the roll gap between the pair of rollers so that when the strip is subsequently passed between the rollers, the relatively short concave edge of the strip is lengthened;

after the roll gap is set, passing the strip between the rollers so that the relatively short concave edge of the strip is lengthened to reduce the initial amount of camber; and after the strip is passed between the rollers, passing the strip through a roll-forming line to form a structural member.

8. Method of removing camber from a strip of material having an initial amount of camber, the strip having a relatively short concave edge and a relatively long convex edge, with the use of a pair of rollers having a roll gap between them, said method comprising the steps of:

setting the roll gap between the pair of rollers to a non-uniform width so as to lengthen the relatively short concave edge of the strip; and passing the strip between the rollers so that the relatively short concave edge of the strip is lengthened to reduce the initial amount of camber.

9. Method of forming as defined in claim 8 wherein said passing step is performed after said setting step.

10. Method of forming a strip of material having an initial amount of camber, the strip having a relatively short concave edge and a relatively long convex edge, with the use of a pair of rollers having a roll gap between them and a roll-forming line, said method comprising the steps of:

setting the roll gap between the pair of rollers to a non-uniform width so as to lengthen the relatively short concave edge of the strip;

passing the strip between the rollers so that the relatively short concave edge of the strip is lengthened to reduce the initial amount of camber; and passing the strip through a roll-forming line to form a structural member.

11. Method of forming as defined in claim 10 wherein said step of passing the strip between the rollers is performed after said setting step and wherein said step of passing the strip through a roll-forming line is performed after said step of passing the strip between the rollers.

* * * * *